US006264499B1

(12) United States Patent
Costello et al.

(10) Patent No.: US 6,264,499 B1
(45) Date of Patent: Jul. 24, 2001

(54) ELECTRONIC MODULE GUIDE FRAME HAVING LIGHT TRANSMISSION MEMBERS

(75) Inventors: Brian P. Costello, Scotts Valley, CA (US); John W. Eberenz, Woodinville, WA (US); James H. Hyland, Hummelstown, PA (US)

(73) Assignee: Tyco Electronics Corp., Wilmington, DE (US)

( * ) Notice: Subject to any disclaimer, the term of this patent is extended or adjusted under 35 U.S.C. 154(b) by 0 days.

(21) Appl. No.: 09/517,251

(22) Filed: Mar. 2, 2000

Related U.S. Application Data

(60) Provisional application No. 60/122,330, filed on Mar. 2, 1999.

(51) Int. Cl.[7] ..... H01R 3/00
(52) U.S. Cl. ..... 439/490; 385/92
(58) Field of Search ..... 439/490; 385/92, 385/89; 362/559, 580, 581, 26

(56) References Cited

U.S. PATENT DOCUMENTS

| | | | |
|---|---|---|---|
| 4,069,403 | 1/1978 | Beaudette et al. | 200/51.12 |
| 4,379,606 | 4/1983 | Clark et al. . | |
| 4,397,513 | 8/1983 | Clark et al. . | |
| 4,789,224 | 12/1988 | Bougsty | 350/345 |
| 4,978,317 | 12/1990 | Pocrass | 439/490 |
| 5,146,620 | 9/1992 | Swikle et al. | 455/351 |
| 5,327,328 | 7/1994 | Simms et al. | 362/26 |
| 5,339,178 | 8/1994 | Phelps, III et al. | 359/42 |
| 5,349,504 | 9/1994 | Simms et al. | 362/32 |
| 5,359,492 | 10/1994 | Porter | 361/683 |
| 5,601,451 | 2/1997 | Driones et al. | 439/490 |
| 5,668,654 | 9/1997 | Benjamin et al. | 359/152 |
| 5,767,999 | 6/1998 | Kayner | 359/163 |
| 5,864,468 | 1/1999 | Poplawski | 361/753 |
| 5,876,239 | 3/1999 | Morin et al. | 439/490 |
| 5,876,240 * | 3/1999 | Derstine et al. | 439/490 |
| 5,879,173 | 3/1999 | Poplawski | 438/138 |
| 6,047,172 | 4/2000 | Babineau et al. | 455/300 |

FOREIGN PATENT DOCUMENTS

| | | | |
|---|---|---|---|
| 0 365 698 A1 | 5/1990 | (EP) | H01R/13/717 |

OTHER PUBLICATIONS

AMP is Taking Fibre Channel from . . . , Connecting at a Higher level.™.
AMP Catalog 889003, Issued 11–96, pp. 19–21.
FCI Electronics, Customer Drawing No. 84790, Sheets 1 & 2. Dated Nov. 17, 1998.
FCI Electronics, Customer Drawing No. 84791, Sheets 1–5, Dated Oct. 13, 1998.

* cited by examiner

*Primary Examiner*—Neil Abrams
*Assistant Examiner*—Phuong KT Dinh

(57) ABSTRACT

A electronic module guide frame (10) for mounting onto a circuit board (30) and for receiving a an electronic module therein comprises side walls (12, 14) connected at inner ends thereof with a back wall (16), a front section (18) connecting front ends of the side walls, a light transmission mounting area (48) on an outer surface of one of the side walls adjacent the front section (18), a light transmission unit (46) disposed along the light transmission mounting area, and mounting members (56, 58) provided by the light transmission unit (46) and the light transmission mounting area (48) mounting the light transmission unit onto the light transmission mounting area.

19 Claims, 2 Drawing Sheets

ELECTRONIC MODULE GUIDE FRAME HAVING LIGHT TRANSMISSION MEMBERS

This application claims the benefit of U.S. Provisional Application No. 60/122,330, filed Mar. 2, 1999.

FIELD OF THE INVENTION

The present invention relates to electronic module guide frames and more particularly to guide frames having light transmission members thereon.

BACKGROUND OF THE INVENTION

Light transmission members are known to be used in conjunction with electrical connectors as disclosed in U.S. Pat. No. 5,876,239 wherein the light transmission members extend along housing members of the electrical connectors with inner ends of the light transmission members being disposed adjacent light emitting diodes or devices (LEDs) mounted on a circuit board onto which the electrical connectors are to be mounted while outer ends of the light transmission members are located at a front end of the housing members to display light emanating from the LEDs via the light transmission members.

The construction of the light transmission members and the housing members to which they are mounted is complex. Moreover, assembly of the light transmission members to the housing members is difficult and time consuming. Thus, the complex structure and the difficulty of assembly increase the cost of manufacture of the connectors.

SUMMARY OF THE INVENTION

An important feature of the present invention is to provide light transmission members on an electronic module guide frame that transmit light to a front end of the guide frame from LEDs on a circuit board to indicate the operation of an electronic module, such as a Gigabit Interface Converter (GBIC) module, within the guide frame.

A guide frame according to the present invention comprises side walls, a rear wall and a front section defining an entrance through which an electronic module is inserted for disposition within the frame, a light transmission mounting area on one of the side walls, light transmission members disposed on the light transmission mounting area, and mounting members provided by the light transmission mounting area and the light transmission members mounting the light transmission members on the light transmission mounting area.

The light transmission mounting area includes a light-blocking member along which the light transmission members extend.

The light transmission mounting area is a simple addition to an existing guide frame and the light transmission members can easily be mounted onto the light transmission mounting area.

BRIEF DESCRIPTION OF THE DRAWINGS

An embodiment of the present invention will now be described by way of example with reference to the accompanying drawings in which.

DETAILED DESCRIPTION OF THE INVENTION

Figure 1:
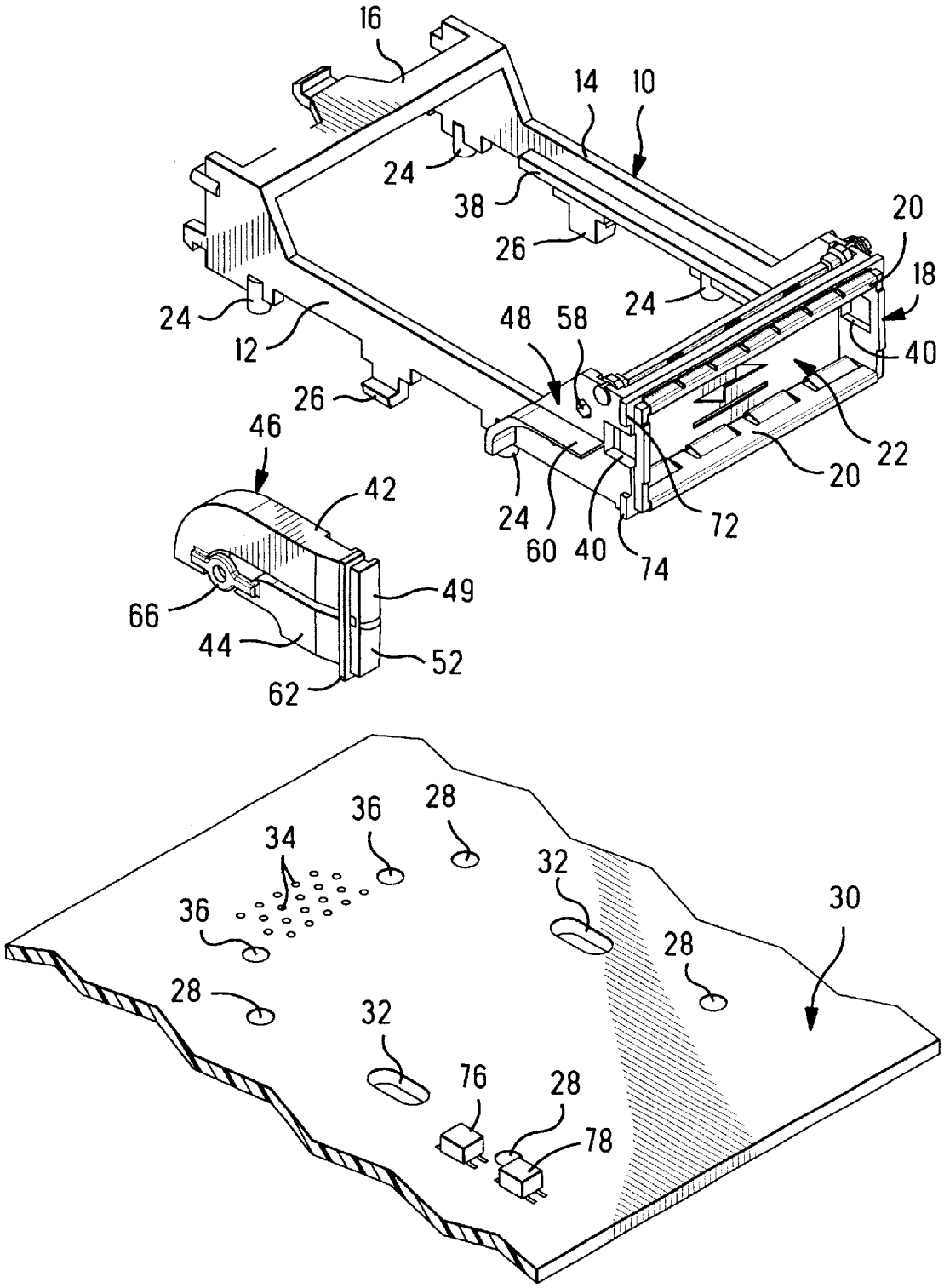
FIG. 1 is an exploded perspective view showing a an electronic module guide frame, light transmission members and a circuit board.
Figure 2:
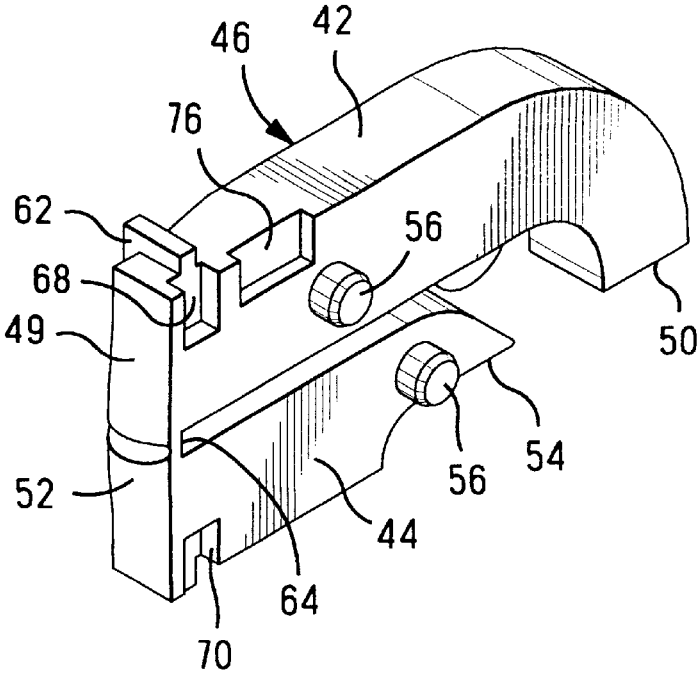
FIG. 2 is a rear view of the light transmission members.
Figure 3:
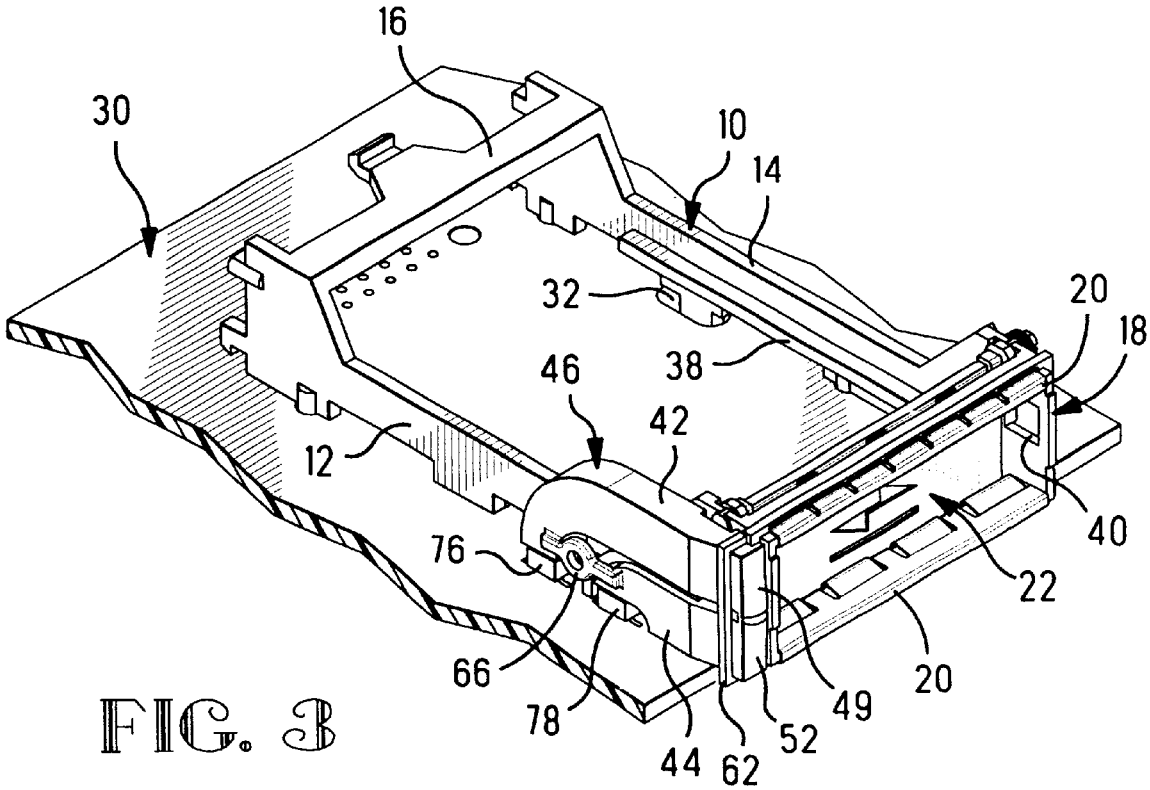
FIG. 3 is a perspective view showing the assembled guide frame mounted onto the circuit board.

Guide frame 10 as shown in FIGS. 1 and 3 is made from a suitable rigid plastic material such as glass-filled nylon, and it includes side walls 12,14, a back wall 16 connecting the back ends of the side walls at upper ends thereof, and a rectangular front section 18 including upper and lower portions and side portions, which are front portions of side walls 12,14. Front section 18 defines an entrance to the guide frame.

Shielding members 20 are mounted onto the upper and lower portions of the front section 18 for electrical engagement with an inside surface of a conductive panel to which the guide frame is mounted, for electrical engagement with spring-biased conductive door 22 that is pivotally mounted adjacent front section 18, and for electrical engagement with shield members on an electronic module, such as a GBIC module, when it is inserted into the guide frame through the entrance thereby moving the closure door to an open position.

Round projections 24 extend outwardly from bottom surfaces of side walls 12, 14 forwardly and rearwardly of L-shaped retention sections 26. Round projections 24 mate with holes 28 in circuit board 30 on which guide frame 10 is mounted as shown in FIG. 3, and L-shaped retention sections 26 are disposed in oblong holes 32 in the circuit board 30 thereby latchably retaining the guide frame 10 thereon.

An electrical connector (not shown) has post sections of electrical contacts thereof mounted in holes 34 of the circuit board and holes 36 receive projections of the housing of the connector.

Rails 38 extend along inside surfaces of side walls 12,14 (only rail 38 on side wall 14 is shown), and the rails act as guides along which the electronic module moves as it is inserted into the guide frame 10 with its electrical connector to be mated with the electrical connector mounted on circuit board 30.

Rectangular openings 40 are located about midway of the side portions of the front section 18, and they receive therein latch projections of the latches on the electronic module to latchably retain the module within the guide frame as disclosed in U.S. Pat. No. 5,767,999 which also describes an electronic module as it is mounted in a guide frame.

Light transmission members 42,44 serve as a light transmission unit 46 that is to be mounted onto a light transmission mounting area 48 located on an outside surface of side wall 12 adjacent the front section 18. Light transmission members 42,44 are made from a translucent material suitable for transmitting light therealong such as Lexan, Lucite or other suitable material. LEDs used with the light transmission members may be of different colors to signify modes of operation of the electronic module system constituting the guide frame and the electronic module located therein.

Light transmission member 42 is J-shaped and includes an output end 49 and an input end 50. Light transmission member 44 has an I-shape and includes an output end 52 and an input end 54. Round projections 56 extend outwardly from inside surfaces of light transmission members 42,44 for disposition within hexagonal holes 58 (only one being shown) located within the light transmission mounting area 48 above and below a J-shaped member 60 thereof. Light transmission members 42,44 are held together as light transmission unit 46 by a projection 62 extending along upper, lower and outside surfaces of the output ends 49,52 and a connecting link 64 therebetween. A connecting link 66 extends across the rear ends of the light transmission members 42,44. Upper and lower recesses 68,70 are located in inner surfaces of the light transmission members 42,44 in general alignment with projection 62 and they accommodate upper and lower projections 72,74 extending outwardly from the side portion of the front section 18. Another recess 76 on the inner surface of the light transmission member 42 at the upper end thereof just inwardly from recess 68 accommodates an end of a pivot section of closure door 22.

Light transmission unit 46 is mounted onto the light transmission mounting area 48 on the side wall 12 of guide frame 10 with projections 56 extending into hexagonal holes 58. The end of the pivot member extends into recess 76. Projections 72,74 extend into recesses 68,70. In addition, light transmission members 42,44 are disposed along separation member 60 as shown in FIG. 3. Separation member 60 separates light transmission member 42 from light transmission member 44 and acts as a light shield to prevent light from being transmitted between light transmission member 42 and light transmission 44. Separation member 60, shown in FIG. 1 and FIG. 3, is shaped to fit the contour of light transmission member 42. However, separation member 60 could be easily adapted to other shapes, while still providing both a separation function and a light shielding function. Projections 56 can be friction-fitted into hexagonal holes 58 or an adhesive can be used therebetween thereby maintaining the light transmission unit 46 onto guide frame 10 with the output ends 49,52 of the light transmission members 42,44 being disposed at the front end of the frame 10. Thus, when the front section 18 of the guide frame 10 is disposed within an opening of the conductive panel, the output ends 49, 52 are also disposed in the opening and projection 62 extends along the inner surface of the panel along with a flange on the front section 18 in alignment therewith.

When the guide frame 10 is mounted onto the circuit board 30 with the light transmission unit 46 mounted thereon, the input ends 50,54 are disposed along light emitting diodes or devices (LEDs) 76,78, which are surface mounted onto the circuit board when the electrical connector and any other component is soldered thereto. Thus, light emanating from the LEDs will be transmitted via the light transmission members 42,44 to the output ends 49,52 thereby indicating the mode of operation of the electronic module system. Separation member 60 will prevent most light from transferring from one light transmission member to the other so as to preclude any interference. A particular advantage is the fact that the separation member 60 shields light transmitted from LED 78 and prevents this light from passing through light transmission member 44, directly into light transmission member 42.

From the foregoing, a guide frame with light transmission members thereon has been described whereby the mode of operation of the electronic module system associated with the guide frame is indicated by the light transmission members as a result of light emanating from the LEDs associated with the light transmission members.

The light transmission unit 46 can be mounted onto the conductive guide frames disclosed in U.S. patent application Ser. No. 60/119,878 filed Feb. 12, 1999.

The frame and the light transmission unit can be an integral unit with the frame being molded from the glass-fitted nylon and the light transmission unit being molded from translucent material. Alternatively, the frame and the light transmission unit can be molded from translucent material.

An advantage of the present invention is the non-complex structure of the frame and light transmission unit.

Another advantage of the present invention is the ease of assembly of the light transmission unit onto the frame.

The guide frame and light transmission unit of the present invention and many of its attendant advantages will be understood from the foregoing description. It is apparent that various changes may be made in the form, construction, and arrangement of parts thereof without departing from the spirit or scope of the invention, or sacrificing all of its material advantages.

We claim:

1. A guide frame for mounting onto a circuit board and for receiving a module therein, comprising:

side walls connected at inner ends thereof with a back wall;

a front section connecting front ends of the side walls;

a light transmission mounting area on an outer surface of one of the side walls adjacent the front section;

a light transmission unit disposed along the light transmission mounting area; and mounting members provided by the light transmission mounting area and the light transmission unit mounting the light transmission unit on the light transmission mounting area.

2. A guide frame as claimed in claim 1, wherein the light transmission unit comprises a J-shaped light transmission member and an I-shaped light transmission member.

3. A guide frame as claimed in claim 2, wherein input ends of the light transmission members are disposed along light emitting devices on the circuit board, and output ends of the light transmission members are disposed at a front end of the front section.

4. A guide frame as claimed in claim 2, wherein a J-shaped member is located on the light transmission mounting area and the J-shaped light transmission member extends along one side of the J-shaped member in correspondence therewith, and the I-shaped light transmission member extends along the other side of the J-shaped member.

5. A guide frame as claimed in claim 1, wherein the mounting members comprise projections on the light transmission unit that are disposed in holes in the light transmission mounting area.

6. A guide frame as claimed in claim 5, wherein the projections on the light transmission unit are round and the holes in the light transmission mounting area are hexagonal.

7. A guide frame as claimed in claim 3, wherein a projection connects the output ends together along with a connecting link therebetween, and another connecting link connects the rear ends of the light transmission members together.

8. A light transmission unit for transmitting light therealong from at least one light source to an output, the light transmission unit being mounted along a housing and comprising:

a plurality of adjacent light guide members, each light guide member extending from a light input end disposed proximate the at least one light source to a light output end, each light guide member being spaced from the adjacent light guide member to accommodate a separation member therebetween, where the separation member extends between the light input end and the light output end from a mounting area on a side of the housing and reduces light from being transmitted between the adjacent light guide members.

9. A light transmission unit as claimed in claim 8, wherein the housing is a frame for receiving an electronic module.

10. A light transmission unit as claimed in claim 8, wherein the plurality of light guide members comprises a J-shaped light transmission member and an I-shaped light transmission member.

11. A light transmission unit as claimed in claim 10, wherein the separation member is J-shaped to conform to the J-shaped light transmission member.

12. A frame for receiving an electrical device therein, comprising:

a light transmission unit disposed on a mounting section of the frame and having an upper light guide and a lower light guide, the upper light guide disposed over the lower light guide and extending substantially parallel thereto;

a light input end on the upper light guide disposed over a first light source located rearward of a second light source;

a light input end of the lower light guide disposed over the second light source; and a light shield extending from the mounting section of the housing and projecting between the upper light guide and the lower light guide along a substantial portion of a length from the light sources to an output end.

13. A frame as claimed in claim 12, wherein the upper light guide is J-shaped and the lower light guide is I-shaped.

14. A frame as claimed in claim 13, wherein the light shield is J-shaped and conforms to the upper light guide.

15. A frame as claimed in claim 12, wherein the first light source and the second light source are light emitting diodes mounted on a printed circuit board.

16. A frame as claimed in claim 12, wherein the electrical device is an electronic module and modes of operation of the electronic module are indicated by the light transmission unit via the first light source and the second light source.

17. A frame as claimed in claim 12, wherein projections on the light transmission unit are received in holes in the mounting section of the frame to secure the light transmission unit to the mounting section.

18. A frame as claimed in claim 17, wherein the projections are round and the holes are hexagonal.

19. A frame as claimed in claim 12, wherein the upper light guide and the lower light guide are connected by at least one connecting link therebetween.

* * * * *